US010378296B2

(12) United States Patent
Downey et al.

(10) Patent No.: US 10,378,296 B2
(45) Date of Patent: Aug. 13, 2019

(54) SEALED DOWNHOLE EQUIPMENT AND METHOD FOR FABRICATING THE EQUIPMENT

(71) Applicant: Halliburton Energy Services, Inc., Houston, TX (US)

(72) Inventors: Luke Christopher Downey, Kingwood, TX (US); Paul Joseph Jones, Houston, TX (US); Nicholas Frederick Budler, Claremore, OK (US); Lonnie C. Helms, Humble, TX (US); Todd Anthony Stair, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 143 days.

(21) Appl. No.: 15/511,463

(22) PCT Filed: Oct. 23, 2014

(86) PCT No.: PCT/US2014/061930

§ 371 (c)(1),
(2) Date: Mar. 15, 2017

(87) PCT Pub. No.: WO2016/064396

PCT Pub. Date: Apr. 28, 2016

(65) Prior Publication Data

US 2017/0292338 A1 Oct. 12, 2017

(51) Int. Cl.
*E21B 33/16* (2006.01)
*E21B 23/00* (2006.01)
(Continued)

(52) U.S. Cl.
CPC ..... *E21B 23/00* (2013.01); *E21B 21/10* (2013.01); *E21B 33/13* (2013.01); *E21B 33/14* (2013.01); *E21B 33/16* (2013.01); *E21B 34/06* (2013.01)

(58) Field of Classification Search
CPC ..... E21B 21/10; E21B 33/14; E21B 33/16
See application file for complete search history.

(56) References Cited

U.S. PATENT DOCUMENTS 2,513,614 A 7/1950 Barkhuff, Jr.
3,255,819 A 6/1966 Scott et al.
(Continued)

FOREIGN PATENT DOCUMENTS

CA 2311362 A1 6/1999
CA 2292663 C 8/2007
(Continued)

OTHER PUBLICATIONS

International Search Report and Written Opinion dated Jun. 30, 2015, issued by the International Searching Authority corresponding PCT Application No. PCT/US2014/061930.

*Primary Examiner* — Kipp C Wallace
(74) *Attorney, Agent, or Firm* — McAfee & Taft

(57) ABSTRACT

A method and apparatus for preventing fluid flow and contamination to a cement body includes a resin cap covering an exposed end of the cement body. The cement body may attach an inner sleeve to an outer sleeve. The fluid flowing through the outer sleeve is prevented from contacting the exposed surface by the resin cap. Resin caps at both ends of the cement body along with resin layers along the side may be included. The resin prevents contamination and creation of micro-annuli in the cement body.

14 Claims, 6 Drawing Sheets

(51) Int. Cl.

| | |
|---|---|
| ***E21B 33/14*** | (2006.01) |
| ***E21B 21/10*** | (2006.01) |
| ***E21B 33/13*** | (2006.01) |
| ***E21B 34/06*** | (2006.01) |

(56) References Cited

U.S. PATENT DOCUMENTS 3,332,499 A * 7/1967 Harris ..... E21B 21/10 166/242.8
3,920,787 A * 11/1975 McDowell ..... B29C 66/1122 264/263
3,957,114 A 5/1976 Streich
4,067,358 A 1/1978 Streich
4,182,423 A * 1/1980 Ziebarth ..... E21B 7/061 166/117.5
4,361,336 A * 11/1982 Reeh ..... B28B 19/0038 138/109
4,560,188 A * 12/1985 Berti ..... F16L 59/143 285/47
4,712,619 A 12/1987 Stepp et al.
H001163 H * 4/1993 Bone ..... 156/294
5,199,489 A * 4/1993 Johnson ..... C09K 8/42 166/291
5,450,903 A 9/1995 Budde
5,472,053 A * 12/1995 Sullaway ..... E21B 17/14 166/327
5,511,618 A 4/1996 Budde
5,567,748 A 10/1996 Klein et al.
5,615,976 A * 4/1997 Fujimoto ..... E21B 7/20 405/184
5,647,434 A 7/1997 Sullaway et al.
5,680,902 A 10/1997 Giroux et al.
5,690,177 A 11/1997 Budde
5,697,442 A 12/1997 Baldridge
5,787,978 A * 8/1998 Carter ..... E21B 7/061 166/117.6
5,836,395 A 11/1998 Budde
5,909,771 A 6/1999 Giroux et al.
6,056,053 A 5/2000 Giroux et al.
6,328,107 B1 12/2001 Maus
6,431,274 B1 * 8/2002 Nowlin ..... E21B 33/1277 166/187
7,114,560 B2 10/2006 Nguyen et al.
2002/0129944 A1 9/2002 Moore et al.
2005/0155663 A1 * 7/2005 Dhellemmes ..... F16L 59/029 138/149
2008/0110625 A1 5/2008 Arcement et al.
2014/0216742 A1 * 8/2014 Darbe ..... E21B 33/14 166/285
2014/0262269 A1 * 9/2014 Watters ..... E21B 33/13 166/293
2016/0040038 A1 * 2/2016 Cornelissen ..... C09D 5/00 427/386
2016/0290550 A1 * 10/2016 Shah ..... B32B 1/00

FOREIGN PATENT DOCUMENTS

EP 0255269 A3 2/1989
EP 0225269 B1 9/1991
EP 0752047 B1 12/2000
EP 0986690 B1 2/2003
WO 9525873 A1 9/1995
WO 9855729 A1 12/1998
WO 9927226 A1 6/1999

* cited by examiner

SEALED DOWNHOLE EQUIPMENT AND METHOD FOR FABRICATING THE EQUIPMENT

Typically, after a well for the production of oil and/or gas has been drilled, casing will be lowered into and cemented in the well. Different types of equipment cemented in the casing often utilize a cementitious material as a bonding or filling medium. For example, a landing collar defining a landing seat may be affixed in a collar, or casing joint with cementitious material. Floating equipment, such as, but not limited to, float shoes and/or float collars are also used in the casing string. Typical of the float equipment that might be used is the Halliburton Super Seal™ float collar and the Halliburton Super Seal™ Float Shoe.

The float equipment typically consists of a valve affixed to an outer case which allows fluid to flow down through the casing but prevents flow in the opposite direction. Because upward flow is obstructed, a portion of the weight of the casing will float or ride on the well fluid thus reducing the amount of weight carried by the equipment lowering the casing into the well.

Once the casing is installed into the wellbore, cement fluid is commonly pumped from the surface through the casing into the wellbore at the lower end of the casing. The cement is lifted up the annulus with pressure pumping equipment because the weight or density of the cement is generally greater than the weight or density of the displacement fluid pumped behind the cement. After displacement operations are completed, the casing is filled with displacement fluid and cement is located in the annular space between the casing and the wellbore for the purpose of creating annular isolation, at which point the surface pressure is released and the valve holds the cement in place by creating a barrier for holding differential pressure.

The float equipment is typically fabricated by affixing a check valve in an outer sleeve, or outer case, which is adapted to be threaded directly into a casing string. The valve is affixed by filling the annulus between the valve housing and the outer sleeve with a cementitious material to form a cement body portion. At times, a micro-annulus between the cement body portion and the outer sleeve and between the cement body portion and the valve may occur. Fluid flowing through the casing can flow through the micro-annulus thus eroding the cement body portion and causing a leak. The leakage through the micro-annulus will allow the cement used to cement the casing in place to re-enter the inner diameter of the casing after the cementing job is completed. Fluid may also pass through tiny cracks in the material used to affix the valve housing to the outer sleeve.

It is important that there be a competent bond between the cement body and the valve and between the cement body and the casing, which avoids leakage so that the bond provides the desired hydraulic pressure rating and holds the needed differential pressure.

BRIEF DESCRIPTION OF THE DRAWINGS

FIGS. 5 and 6 are embodiments of downhole tools that comprise a landing seat assembly.

DESCRIPTION OF THE EMBODIMENTS

In one embodiment there is provided a downhole tool for use in a well comprising an outer sleeve, or outer case adapted to be connected in a casing string. An inner sleeve, or inner case may be connected to the outer sleeve with a bonding material, which may be for example, a cementitious material that forms a cement body. The outer sleeve defines a flow passage therethrough and the inner sleeve affixed thereto has an open bore to communicate with the central flow passage. The inner sleeve in one embodiment may be a landing collar designed to receive a ball, plug, dart or other flow restrictor that will engage the landing seat.

In another embodiment the downhole tool may comprise a floating apparatus for use in a well casing comprising the outer sleeve affixed to a valve with the cement body. The outer sleeve is configured to be connected in the well casing. The valve comprises the inner sleeve, which may also be referred to as a valve housing connected to the outer sleeve. The valve housing has an interior that defines a bore in fluid flow communication with the central flow passage, and has an exterior surface opposing the inner surface of the outer sleeve. An annulus is defined by the valve housing and the outer sleeve. The annulus is filled with the cementitious material to form the cement body which affixes the inner sleeve to the outer sleeve. The annulus and the cement body have upper and lower ends.

A resin-type material is applied to one or both of the first and second ends of the cement body to prevent fluid from contacting, and degrading or contaminating the cement body. The resin-type material at the ends may be referred to as resin caps. Resin-type material may also be placed in any space between the surface of the outer sleeve and the cement body, and any space between the inner sleeve and the cement body. The material may be injected through a port in the outer sleeve or pumped into the space from the upper and/or lower ends. In one embodiment, the resin-type material may cover both ends of the cement body and both of the inner and outer surfaces of the cement body so that the resin completely encapsulates the cement body. In a separate embodiment, the inner sleeve may be affixed to the outer sleeve with a composite material comprising a cementitious material and a resin-type material mixed together in desired ratios.

A method of sealing downhole equipment may comprise affixing an outer case to an inner case with a first material and applying a resin-type material to at least a portion of an exposed exterior surface of the first material.

The applying step may comprise brushing the resin-type material on exterior surfaces of the first material, which may comprise the cementitious material. The method may also comprise injecting resin-type material through a portion of the outer sleeve to fill any gaps between the inner surface of the outer sleeve and an exterior surface of the first material.

Figure 1:
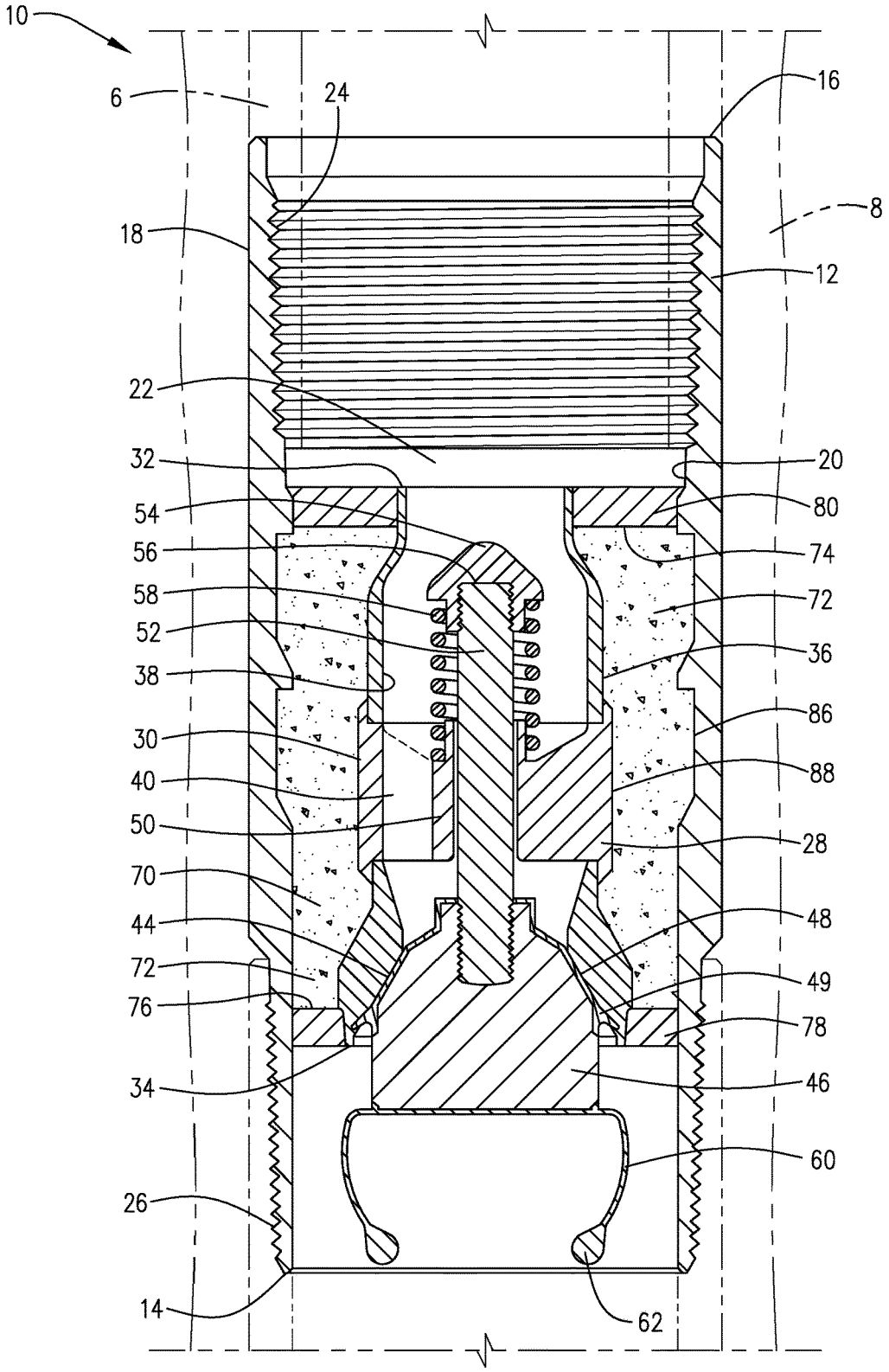
FIG. 1 is a cross-sectional view of a downhole tool that comprises a float collar illustrating one embodiment of the invention.

Referring now to the drawings, and more particularly to FIG. 1, a downhole tool is shown and generally designated by the numeral 10. The downhole tool of FIG. 1 is a float apparatus, and more particularly a float collar 10. Float collar 10 is shown connected in a casing 6 disposed in a wellbore 8. The float collar 10 includes an outer sleeve or outer case 12, which has a first, or lower end 14, and a second, or upper end 16, an outer surface 18 and an inner surface 20. In the case of float collar 10, outer sleeve 12 comprises a float collar body. Inner surface 20 defines a central flow passage 22. Float collar 10 may include an inner thread 24 at its upper end 16, and an outer thread 26 at its lower end 14, thereby configuring float collar 10 to be integrally connected in casing string 6 thereabove and therebelow. After float collar 10 is attached to casing string 6, casing string 6, including float collar 10, is lowered into wellbore 8. Once casing string 6 is in place, cement is flowed down and out the lower end of casing string 6 and will fill the annulus between the outer surface of casing string 6 and wellbore 8, thus cementing casing 6 in place.

A valve 28 is disposed in outer case 12. Valve 28 will generally be a check valve. Valve 28 includes an inner sleeve 30, which may be referred to as valve housing 30 of float collar 10. Valve housing 30 has upper end 32, a lower end 34, an exterior, or outer surface 36 and an interior, or inner surface 38. Interior surface 38 defines a bore 40 extending from upper end 32 to lower end 34. Bore 40 communicates with and forms a part of flow passage 22. An annulus 70 is defined between valve housing 30 and outer sleeve 12. Annulus 70 is defined by inner surface 20 of outer sleeve 12 and exterior surface 36 of valve housing 30.

A valve seat 44 is defined on interior surface 38. Valve 28 further includes a valve element 46 having a sealing surface 48, which sealingly engages valve seat 44 in the position shown in FIG. 1. A lip seal 49 may be defined on sealing surface 48. A valve guide 50 disposed in valve housing 30 slidingly receives a valve stem 52, which extends upwardly (or towards upper end 32) from valve element 46. A valve cap 54 is attached to an upper end 56 of valve stem 52. A valve spring 58 is disposed about valve stem 52 between valve cap 54 and valve guide 50. Valve spring 58 biases valve cap 54 upwardly thereby sealingly engaging valve seat 44 and sealing surface 48 of valve element 46. Valve spring 58 may be in an expanded or relaxed state when sealing surface 48 sealingly engages valve seat 44 but, more typically, will be in a partially compressed state thereby assuring sealing contact. As will be readily seen from FIG. 1, when sealing surface 48 moves downward (or towards lower end 34), valve spring 58 will be further compressed. Fluid pressure acting on valve element 46 will cause valve element 46 to move downwardly to the position shown therein, so that a space is defined between valve element 46 and valve seat 44 which allows fluid flow therethrough.

The valve 28 may further include an auto-fill strap 60 attached to the valve element 46. Auto-fill strap 60 has a rounded end or bead 62 disposed at each end. Beads 62 may be placed between valve seat 44 and sealing surface 48 prior to lowering the casing string into a well, thereby allowing fluid to flow through the casing and through the floating apparatus 10 as it is lowered into the well. Once the casing is in place, fluid is pumped into the float equipment forcing valve element 46 down and releasing the beads 62. Once fluid flow is stopped, valve spring 58 will urge valve stem 52 upwardly, so that sealing surface 48 of valve element 46 sealingly engages valve seat 44.

Cement body 72 is disposed in annulus 70 and has an upper, or second end 74, and a lower, or first end 76. Upper and lower ends 74 and 76 are exposed, and unless covered will be in contact with fluid flowing through casing string 6. Cement body 72 has outer surface 86 and inner surface 88. Cement body 72 is typically comprised of high compressive strength cement. Such cementitious materials shrink as they cure and this shrinkage may create a micro-annulus between valve housing 30 and the cement body 72 and between outer case 12 and cement body 72. Such micro-annuli can allow for undesirable fluid flow communication across floating apparatus 10; in other words, such micro-annuli allow for fluid flow communication other than that controlled by valve 28. The cement body 72 at times may also have porosities that allow fluid to pass therethrough. Well fluid may leak through the micro-annulus and/or can enter the porosities during the well cementing job, thus contaminating the cement and causing a poor cement job. Additionally, once the well cementing job is complete, the valve should operate to keep cement from re-entering the casing; however, the micro-annulus and porosities curing may allow the cement to re-enter the inner diameter of the casing. The cement must then be drilled out of the casing, a process which is time-consuming and costly.

In the embodiment of FIG. 1, a resin cap 78 may cover the bottom or lower end 76 of cement body 72. The resin cap may be comprised of known materials such as for example a water-compatible resin having a low cure temperature (less than 250° F.). The resin should be water compatible to insure a strong bond or strong adhesion between the cementitious material and the bonding material to, thus, provide a bond of adequate strength to resist shear stress and of adequate strength and resilience to resist forming micro-annulus as the cementitious material shrinks during curing of the cementitious material. Suitable water-compatible resins can be selected from one or more water-compatible resins from the group consisting of: two component epoxy-based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if a temperature above about 250° F. is used, preferably above about 300° F. However, lower cure temperatures are preferred as higher cure temperatures may adversely affect the curing of the cementitious material. It is within the ability of one skilled in the art, with the benefit of this disclosure, to select a suitable resin for use in embodiments of the present invention and to determine whether a catalyst is required to trigger curing.

Resin cap 78 which may be referred to as a lower resin cap 78 will provide a seal to prevent fluids flowing through float collar 10 from contacting cement body 72. The embodiment of FIG. 1 also shows a second or upper resin cap 80 which may be made of the same materials described herein. While the embodiment of FIG. 1 shows upper and lower resin caps 78 and 80 it is understood that a single resin cap may be used and may be positioned at either of the ends 74 and 76 of cement body 72. When two resin caps 78 and 80 are used, fluid filling float collar 10 is prevented from contacting the cement body through either end by the resin caps. Resin caps 78 and 80 may be applied by brushing, injecting, pouring or other similar application method. Resin caps 78 and 80 may be applied and cured after cement body 72 has hardened and has affixed the inner sleeve to the outer sleeve. Alternatively, cement body 72 and resin caps 78 and 80 may be cured, or hardened at the same time. When the resin is applied to the cement body prior to hardening a small degree of mixing at the cement body and resin interface may occur while both are in the liquid state. Due to the water compatibility of the resin system, hardening of both systems will not be inhibited.

Figure 2:
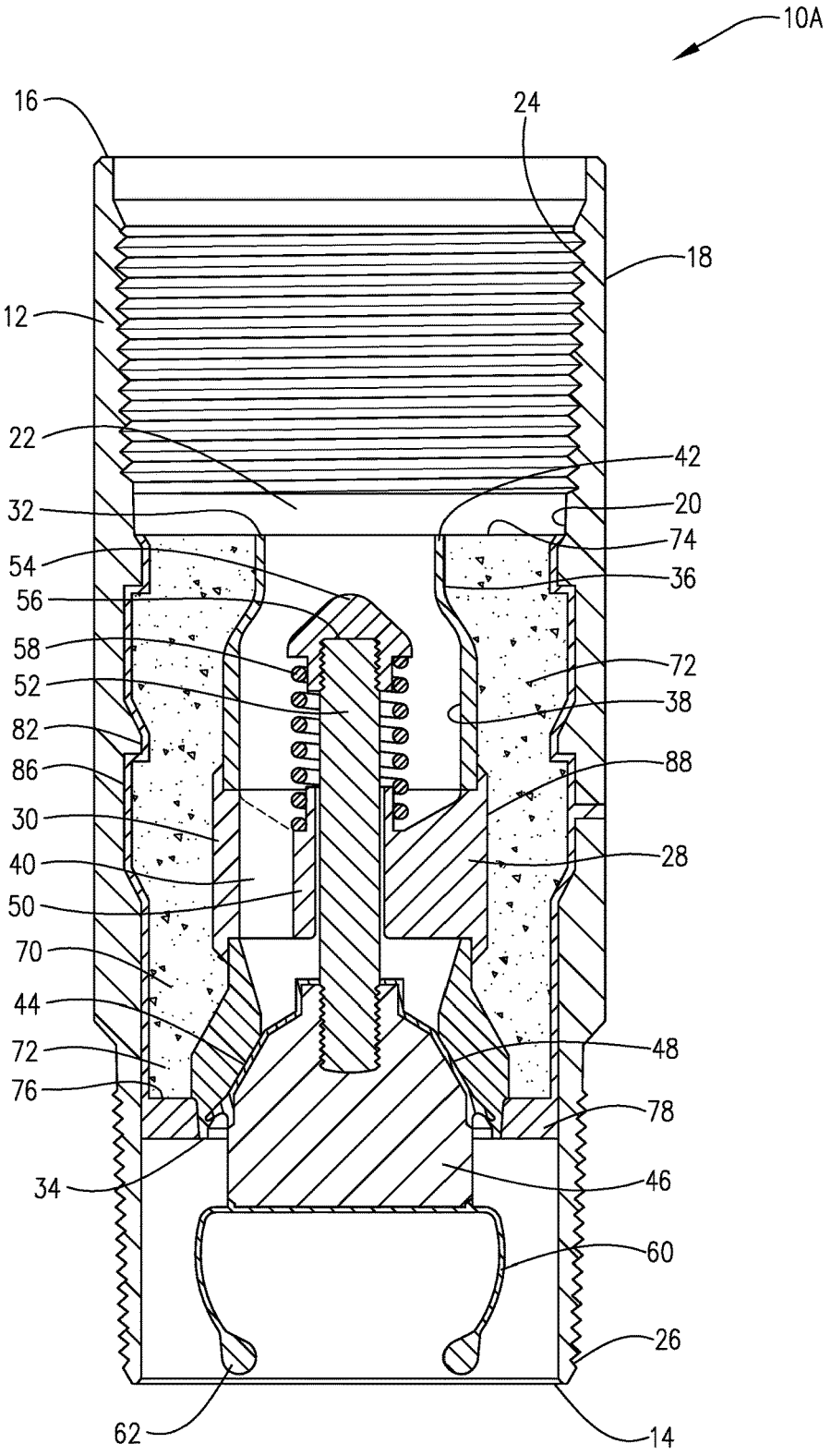
FIGS. 2, 3 and 4 are additional embodiments of a downhole tool that comprise float collars.

Other embodiments of downhole tools are shown in FIGS. 2-7. Common features of the downhole tool 10A in FIG. 2 are generally identical to those of the tool shown in FIG. 1. Float collar 10A has resin cap 78 and a resin layer 82 extending therefrom. Resin layer 82 is disposed between and will fill any gaps or spaces between inner surface 20 of outer sleeve 12 and the outer surface of 86 of cement body 72.

Figure 3:
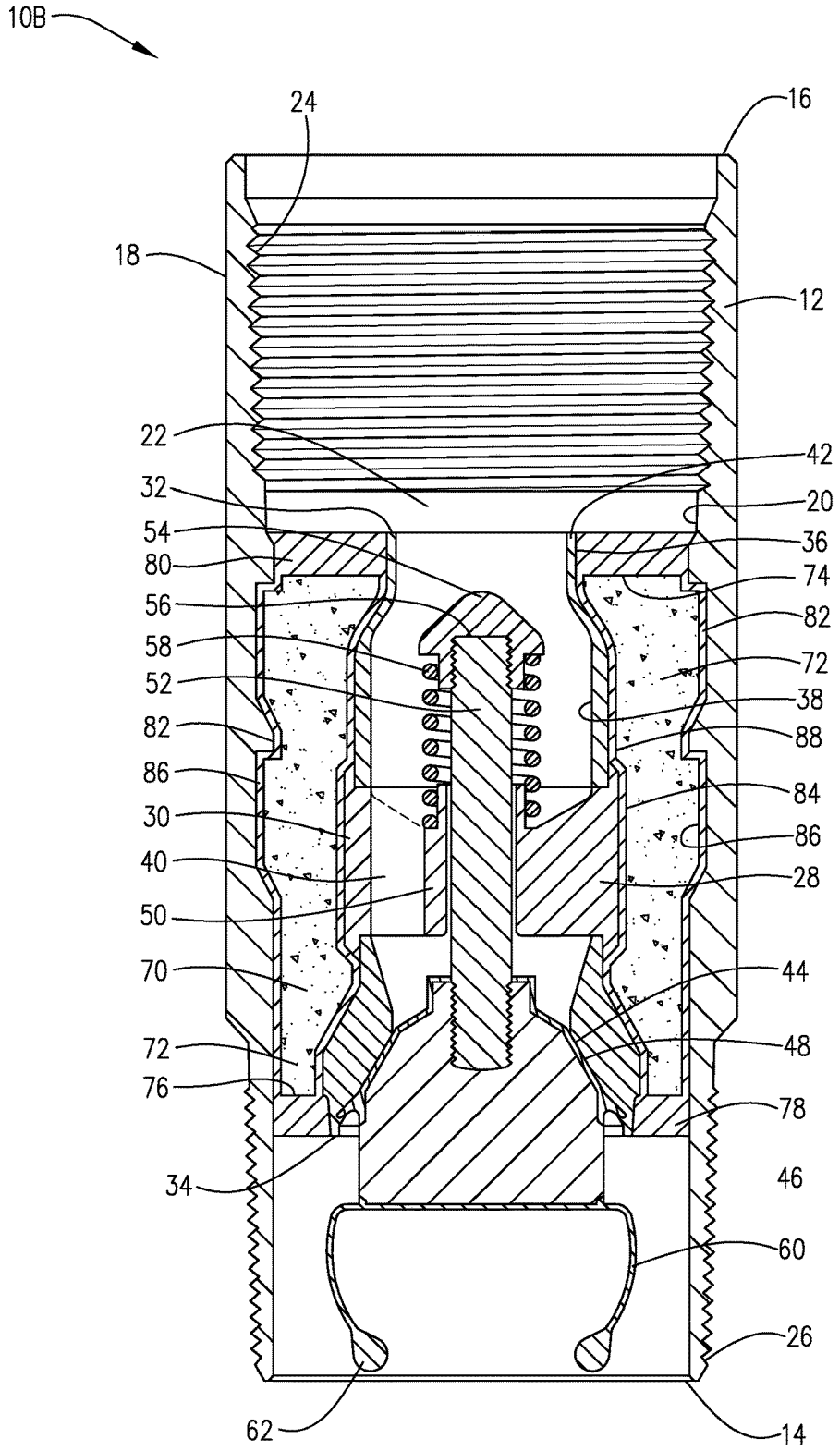
Figure 4:
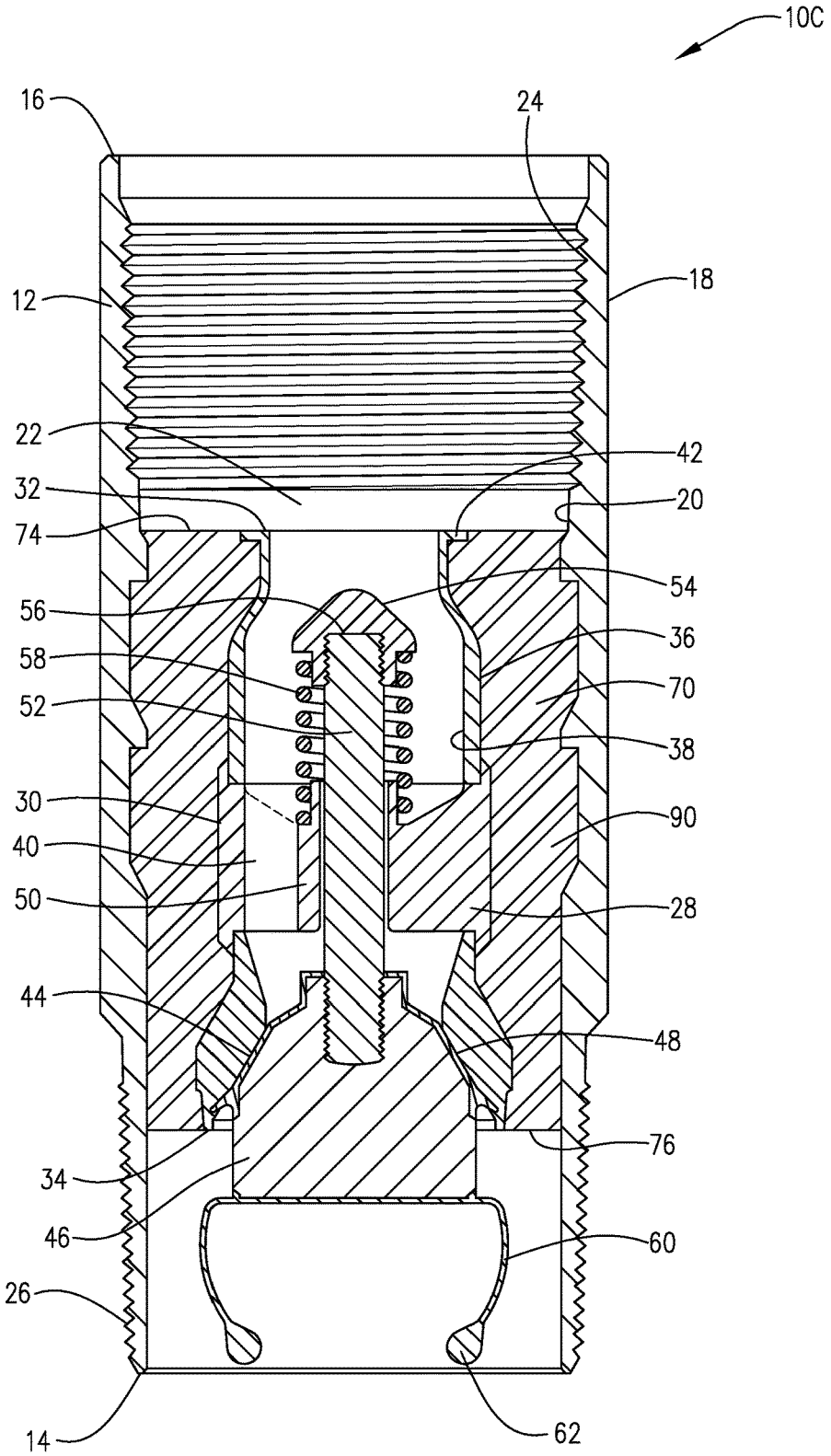

In the embodiment of FIG. 3, tool 10B has two resin caps, namely lower and upper resin caps 78 and 80 included along with outer resin layer 82. An inner resin layer 84 may be positioned in and fill any space between the exterior surface 36 of valve housing 30 and the inner surface 88 of cement body 72. Thus in the embodiment of FIG. 3, resin encapsulates the entire cement body portion to prevent any fluid from contacting cement body 72. While FIG. 3 shows a configuration of upper and lower end caps 78 and 80 and both outer and inner layers 82 and 84, it is understood that any combination may be used. For example, a downhole tool may include either, or both lower cap 78 and upper cap 80 and either, or both outer layer and inner layer 82 and 84. In the embodiment of FIG. 4, in which common features are identified with the same numerals, tool 10C has cement body 90 that affixes outer sleeve 12 to inner sleeve 30. Body 90 is a composite body comprising a cementitious material and a resin material selected from the group described herein. Composite body 90 affixes outer sleeve 12 to inner sleeve 30. The features of the float collar 10C shown in FIG. 4 are identical to those in FIG. 1 except that in the embodiment of FIG. 7, there are no resin caps or layers since composite body 90 provides a stable and efficient seal as a result of the resin cementitious material composite. The ratio of cement to resin, and the type used is a design choice, and the volume fraction of resin in the cement may range from 0.01 to 0.60, 0.10 to 0.40, or preferably 0.15 to 0.30.

Figure 7:
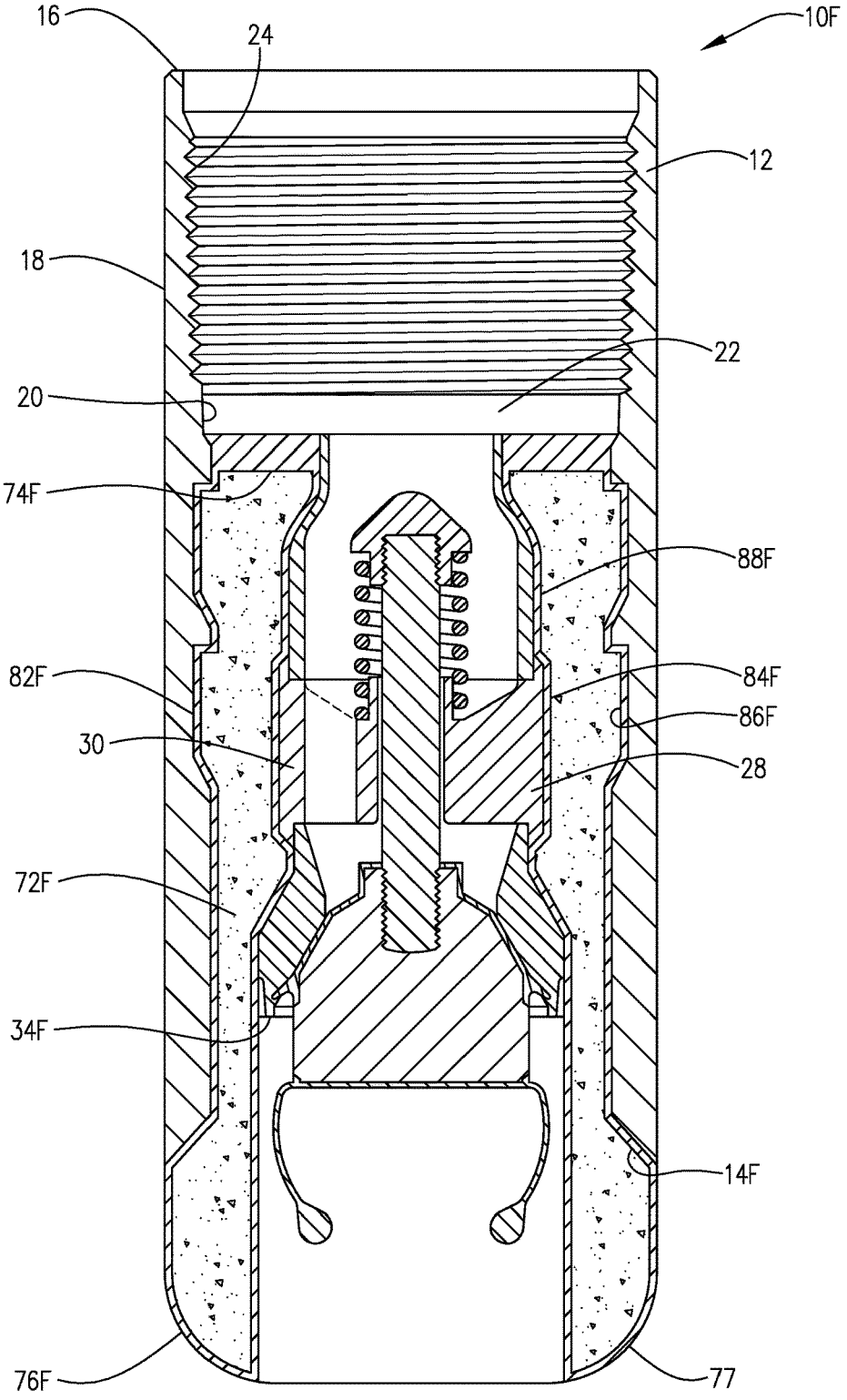
FIG. 7 is a cross-sectional view of a downhole tool comprising a float shoe.

An alternative embodiment is shown in FIG. 7. The embodiment shown in FIG. 7 is generally designated by the numeral 10F. The features that are similar to those shown in FIG. 1 but have been modified are generally designated by the suffix F. The remaining features are substantially identical to the features of the embodiment shown in FIG. 1.

In the embodiment shown in FIG. 7, the floating equipment is a float shoe generally designated by the numeral 10F. The float shoe is similar to and includes many of the same features as the float collar, but is designed to be lowered into the hole ahead of the casing string. Float shoe 10F has an outer sleeve or outer case 12F, which has an upper end 16 and a lower end 14F. Upper end 16 includes a thread 24 so that it may be connected to a string of casing thereabove. Lower end 14F, however, does not include a thread. Float shoe 10F includes a cement body 72F having an upper end 74F and a lower end 76F, which extends below lower end 34 of valve housing 30 and below lower end 14F of outer case 12F. Lower end 76F forms a guide surface 77.

A cap which in the embodiment of FIG. 7 is an upper cap may be a resin cap 78. The embodiment of FIG. 7 may also include one or both of resin layers 82F and 84F which will extend from resin cap 78F. In the embodiment of FIG. 7, resin layers 82F and 84F extend and form a complete unbroken unit such that cement body 72F is completely circumscribed by cap 78F and resin layers 82F and 84F.

Figure 5:
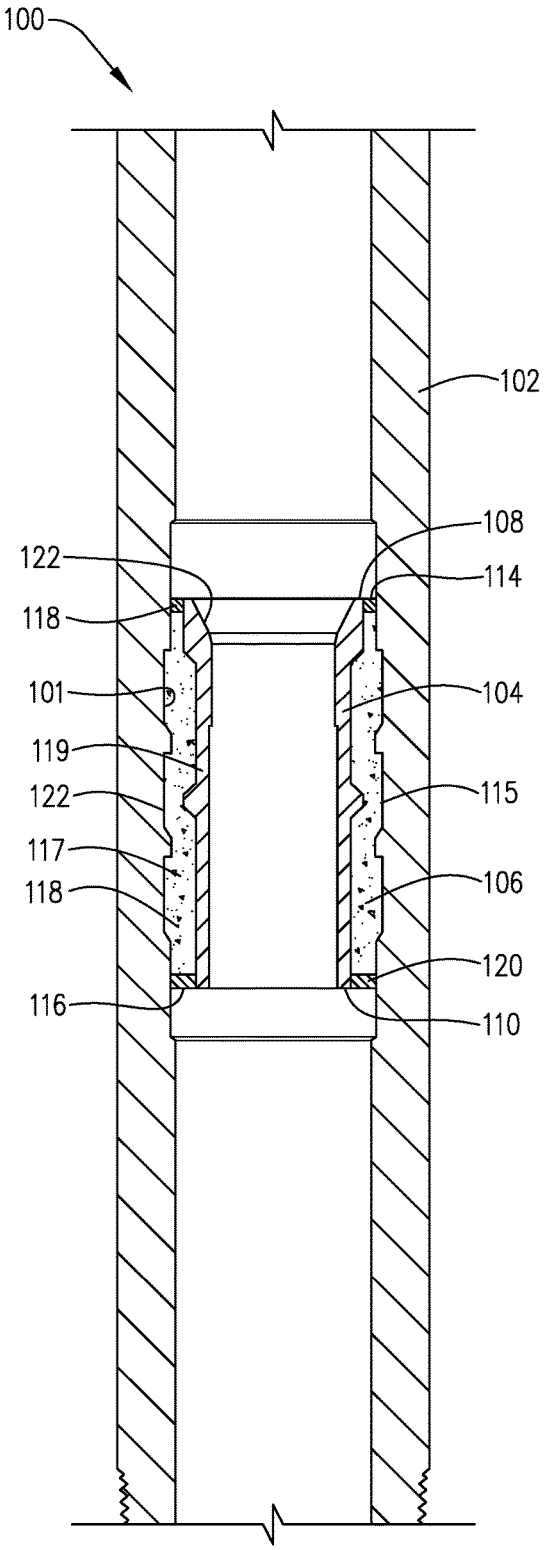
Figure 5:
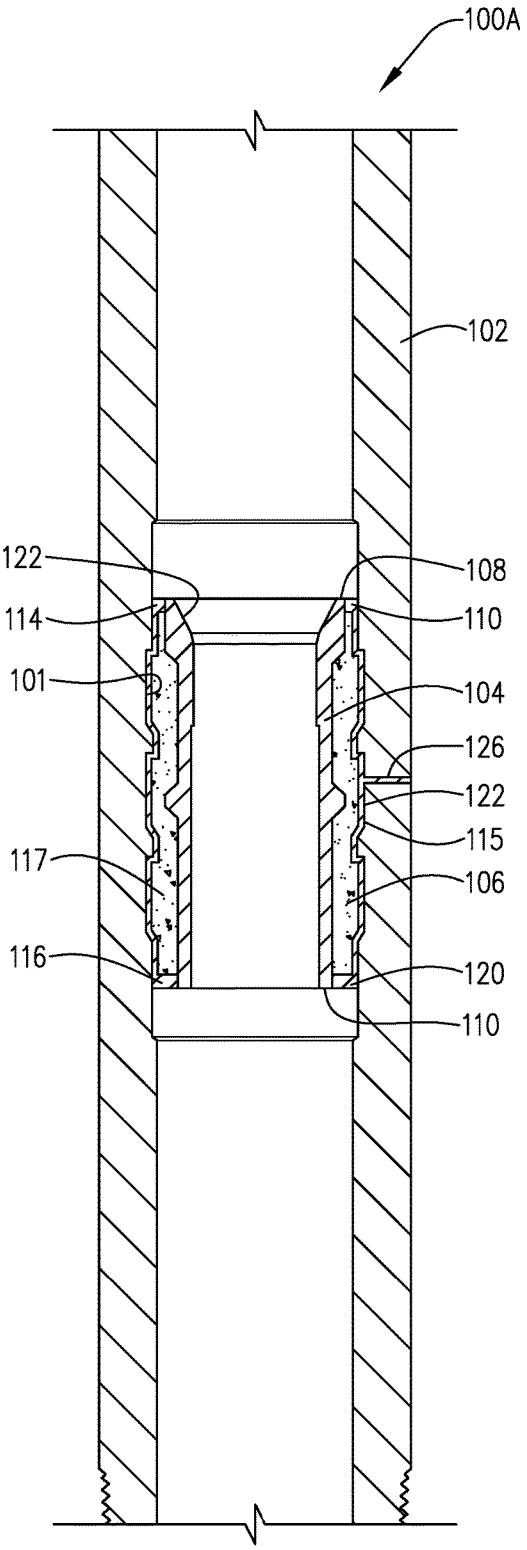

Another example of the downhole tool is shown in FIG. 5. FIG. 5 is a landing collar 100 comprising outer case 102 and inner case or inner sleeve 104. Outer case 102 has inner surface 101. An annulus 106 is defined by and between outer sleeve 102 and inner sleeve 104. Inner sleeve 104 has upper and lower ends 108 and 110, respectively. A landing seat 112 is defined at upper end 108. Annulus 106 has upper and lower ends 114 and 116 which are essentially coterminous with upper and lower ends 108 and 110 of inner sleeve 104. In the embodiment of FIG. 5, cement body 117 has outer surface 115 and inner surface 119. Cement body 117 is positioned in annulus 106 and affixes inner sleeve 104 to outer sleeve 102. Downhole tool 100 may have upper resin cap 118 and lower resin cap 120 to prevent fluid passing through outer sleeve 102 and inner sleeve 104 from contacting cement body 117. As shown in the embodiment 100A of FIG. 6, a resin layer 122 may fill any gaps or space and may be positioned between and inner surface 101 of outer sleeve 102 and an outer surface 115 of cement body 117. An injection port 126 may be positioned in outer sleeve 102 to provide a port through which resin may be injected.

A method of fabricating the downhole tool may comprise providing an outer sleeve or outer case and inner sleeve or inner case. The method may comprise affixing the outer sleeve to the inner sleeve with a cement body and applying resin caps to either or both of the upper and lower ends of the cement body. The caps may be created by pouring, brushing or by similar processes. The resin may be cured after application and may be cured with the cement body, or thereafter. The resin may be used before the cement as well, and bonded during the curing of the cement body. In order to form inner and outer resin layers on the inner and outer surfaces of the cement body encircling the cement body a number of methods may be used. For example, resin may be applied to either the upper or lower end and pressure applied thereto to force resin into any space between the interior surface of the outer sleeve and the exterior surface of the cement body and between the inner surface of the cement body and the outer surface of the inner sleeve. An injection port may be utilized to inject resin through the outer sleeve so that it will coat and fill any spaces between the exterior surface of the cement body and the inner surface of the outer sleeve to create an outer layer of resin. As discussed, the inner and outer resin layers may be used in combination with upper and lower resin caps. In the foregoing manner, the resin caps and layers may be applied to the downhole tools after the outer sleeve has been affixed to the inner sleeve and the cement body has been cured.

Other methods may include pretreating the equipment before it is affixed. In other words, the inner surface of the outer sleeve and the outer surface of the inner sleeve may be coated with the resin and the remainder of the annulus filled with the cement body. Prior to curing of the cementitious material that forms the cement body, the resin caps may be applied by simply pouring or spraying resin to the upper and lower ends of the cement body. The entire assembly may be cured thereafter to cure both the resin and the cementitious material. Other methods of use may include treating downhole tools that may develop cracks or flaws in the cement body with the resin to use as a repairing compound. Thus, the method may include repairing downhole equipment by sealing cracks in float collars and float shoes and filling grooves or other defects in any cement body. A variety of equipment can be mended or repaired so that the resin may be used as a field patch or field treatment kit.

The presence of the resin will increase the shear strength between the cement and the other components. The increased bonding strength will prevent the cement from cracking or debonding when the float equipment is subjected to elevated temperatures and differential pressures while in use. Further, the improved and resilient bond created between the cementitious material and the bonding material improves hydraulic sealing capabilities. The resilient bond prevents the formation of micro-annuli that would allow fluid to flow through the annulus created between the outer sleeve and valve housing. Thus, a reliable hydraulic seal between the valve and outer case that is more easily fabricated and assembled compared to conventional technology is provided by the current invention.

In operation, the tools described herein are first constructed according to the above method. The float apparatus described herein are attached to a casing string. The casing string is then lowered into a well. While the casing string is lowered, bead 62 may be between valve seat 44 and sealing surface 48, thereby allowing fluid to flow through the casing and through floating apparatus 10, thus facilitating the lowering of the casing string into the well by reducing upward force on the casing string caused by fluid pressure in the well. Because annulus 70 has been blocked by cement body portion 72, along with resin caps 78 and/or 80, and layers 82 and/or 84, there are no micro-annuli formed, and no flow of well fluid through annulus 70. Once the casing string is in place, fluid is pumped into the float equipment forcing valve element 46 down and releasing beads 62. When the fluid flow is stopped, spring 58 will urge valve stem 52 upwardly, so that sealing element 48 of valve element 46 sealingly engages valve seat 44. Thus, further flow of fluid upward through valve 28 is prevented. At this point, cement is flowed down and out the lower end of the casing string. The cement fills an annulus between the outer surface of the casing string and the wellbore, thus cementing the casing in place. Next a displacement fluid is pumped down the casing string to move all the cement through valve 28 and into the annulus between the outer surface of the casing string and the wellbore. After displacement operations are completed, the casing is filled with displacement fluid and cement is located in the annular space between the casing and the wellbore, at which point, the surface pressure is released and valve 28 holds the cement in place by creating a barrier for holding differential pressure. During the described well-cementing operation, cement body portion 72 in cooperation with resin caps 78 and/or 80, and layers 82 and/or 84 prevents upward flow of fluid through annulus 70 ensuring hydraulic retention and enhancing mechanical retention. Likewise, in the embodiment of FIG. 4, the composite body 90 will prevent upward flow. The cement body and resin caps 118 and 120 and layers 122 in the embodiments of FIGS. 5 and 6 perform in the same manner.

In the above description terms such as up, down, lower, upper, upwards, downwards and similar terms have been used to describe the placement or movement of elements. It should be understood that these terms are used in accordance with the typical orientation of a casing string; however, the tools disclosed herein are not limited to use in such an orientation. While the certain embodiments have been shown for the purposes of this disclosure, numerous changes in the arrangement and construction of parts may be made by those skilled in the art. All such changes are encompassed within the scope and spirit of the claims.

What is claimed is:

1. A method of sealing a downhole tool comprising:

providing an outer case of the downhole tool having an inner surface, wherein the outer case is configured to be connected to a casing string:

providing an inner case within the outer case so as to form an annulus between an outer surface of the inner case and the inner surface of the outer case:

introducing a cementitious material into the annulus so as to affix the outer case to the inner case with a first material the cementitious material, and wherein the cementitious material forms a cement body with an interior surface opposing the outer surface of the inner case, with an exterior surface opposing the inner surface of the outer case, and with an exposed surface;

forcing a resin into a space between the exterior surface of the cement body and the inner surface of the outer case: and applying the resin to at least a portion of the exposed exterior surface of the cement body.

2. The method of claim 1, the applying step comprising brushing the resin on the at least a portion of the exposed surface.

3. The method of claim 1, wherein the step of forcing the resin into a space further comprises injecting the resin through a port in the outer case to fill any gaps between the exterior surface of the cement body and the inner surface of the outer case.

4. The method of claim 3, further comprising forcing a resin between the interior surface of the cement body and the outer surface of the inner case.

5. The method of claim 3, further comprising applying the resin to all of-the exposed surface of the cement body.

6. The method of claim 3, the injecting step comprising pumping the resin through the port to force the resin into the gaps.

7. The method of claim 1, wherein the downhole tool comprises a float collar.

8. A method of sealing a downhole tool comprising:

providing an outer case of the downhole tool having an inner surface, wherein the outer case is configured to be connected to a casing string;

providing an inner case within the outer case so as to form an annulus between an outer surface of the inner case and the inner surface of the outer case;

connecting an outer case to an inner case with a cement body, wherein the cement body has an interior surface opposing the outer surface of the inner case, with an exterior surface opposing the inner surface of the outer case, and with an exposed surface; and forcing a resin into a space between the exterior surface of the cement body and the inner surface of the outer case so that at least a portion of the exterior surface of the cement body is treated with a resin material.

9. The method of claim 8, the forcing step comprising applying the resin material to the cement body after the tool has been delivered to a field location.

10. The method of claim 8, further comprising covering first and second ends of the cement body with first and second resin caps.

11. The method of claim 8, further comprising filling any space between the outer case and the cement body with the resin material.

12. The method of claim 11, wherein the filling step comprises injecting the resin through a port in the outer case.

13. The method of claim 8, wherein the forcing step further comprises forcing the resin to a space between the interior surface of the cement body and the outer surface of the inner case.

14. The method of claim 13, wherein the forcing step further comprises applying the resin to an exposed end of the cement body and applying pressure thereto to force the resin into any space between the exterior surface of the cement body and the inner surface of the outer case and any space between the interior surface of the cement body and the outer surface of the inner case.

* * * * *